US012023730B2

(12) United States Patent
Fukunaga et al.

(10) Patent No.: US 12,023,730 B2
(45) Date of Patent: Jul. 2, 2024

(54) STOPPER FOR CONTINUOUS CASTING AND CONTINUOUS CASTING METHOD

(71) Applicant: KROSAKIHARIMA CORPORATION, Fukuoka (JP)

(72) Inventors: Shinichi Fukunaga, Fukuoka (JP); Toshio Kaku, Fukuoka (JP); Hiroki Furukawa, Fukuoka (JP); Takuya Okada, Fukuoka (JP)

(73) Assignee: KROSAKIHARIMA CORPORATION, Fukuoka (JP)

( * ) Notice: Subject to any disclaimer, the term of this patent is extended or adjusted under 35 U.S.C. 154(b) by 224 days.

(21) Appl. No.: 17/417,461

(22) PCT Filed: Dec. 18, 2019

(86) PCT No.: PCT/JP2019/049519

§ 371 (c)(1),
(2) Date: Jun. 23, 2021

(87) PCT Pub. No.: WO2020/137722

PCT Pub. Date: Jul. 2, 2020

(65) Prior Publication Data

US 2022/0062984 A1 Mar. 3, 2022

(30) Foreign Application Priority Data

Dec. 25, 2018 (JP) ..... 2018-241497

(51) Int. Cl.
*B22D 41/18* (2006.01)
*B22D 11/18* (2006.01)

(52) U.S. Cl.
CPC ..... *B22D 41/18* (2013.01); *B22D 11/18* (2013.01); *B22D 41/186* (2013.01)

(58) Field of Classification Search
CPC ..... B22D 41/16; B22D 41/18; B22D 41/186
See application file for complete search history.

(56) References Cited

U.S. PATENT DOCUMENTS 4,706,944 A 11/1987 Lee
4,791,978 A 12/1988 Fishler
(Continued)

FOREIGN PATENT DOCUMENTS

CN 204381357 U * 6/2015
JP 1990006040 A 1/1990
(Continued)

OTHER PUBLICATIONS

International Search Report dated Jan. 10, 2020 for PCT/JP2019/049519 filed Dec. 18, 2019.
(Continued)

*Primary Examiner* — Kevin E Yoon
(74) *Attorney, Agent, or Firm* — Paul D. Bianco; Fleit Intellectual Property Law

(57) ABSTRACT

The precision of grasping or controlling backpressure around a gas discharge portion in a stopper for continuous casting can be improved with a stopper for continuous casting which includes a cavity for conveying gas in a vertical direction center of the stopper, one or a plurality of gas discharge holes passing through from the cavity to the outside in a distal center or a side surface of a reduced-diameter region including a fitted portion to a lower nozzle, and a pressure control component in a part of an area above the gas discharge hole within the cavity.

4 Claims, 7 Drawing Sheets

(56) References Cited

U.S. PATENT DOCUMENTS

| | | | |
|---|---|---|---|
| 5,071,043 | A | 12/1991 | Dumazeau |
| 6,367,671 | B1 | 4/2002 | Hanse et al. |
| 2011/0260092 | A1 | 10/2011 | Nitzi et al. |
| 2012/0001372 | A1 | 1/2012 | Nitzi et al. |

FOREIGN PATENT DOCUMENTS

| | | | | | |
|---|---|---|---|---|---|
| JP | 1991081061 | A | | 4/1991 | |
| JP | 03110048 | A | * | 5/1991 | |
| JP | 2002530200 | A | | 9/2002 | |
| JP | 2013043199 | A | | 3/2013 | |
| KR | 1020160051354 | A | * | 5/2016 | ..... B22D 11/10 |

OTHER PUBLICATIONS

Written Opinion for PCT/JP2019/049519 filed Dec. 18, 2019.
International Preliminary Report on Patentability, dated Jun. 16, 2021, with Written Opinion for PCT/JP2019/049519 filed Dec. 18, 2019 (English translation).

* cited by examiner

Fig. 3A
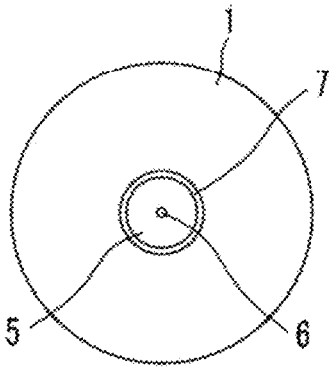
Fig. 3B
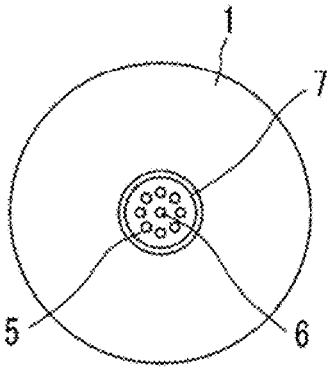
Fig. 3C
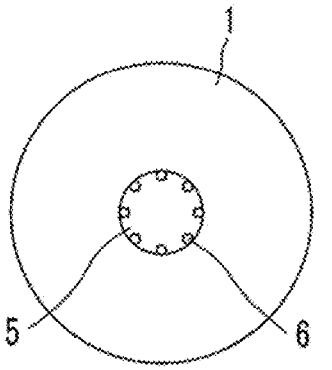
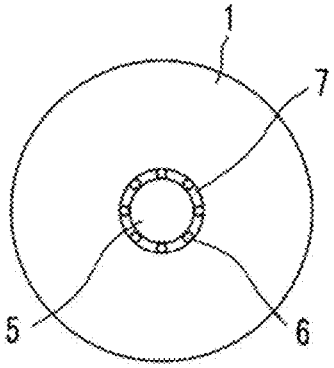
Fig. 3D
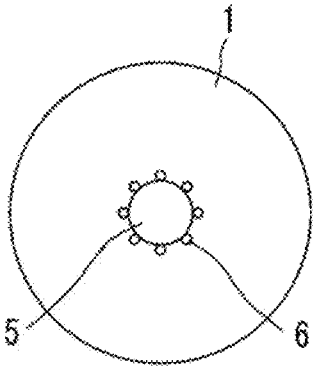
Fig. 3E
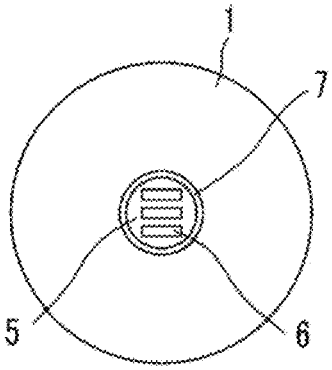
Fig. 3F
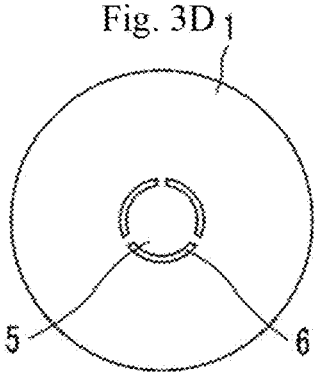
Fig. 3G
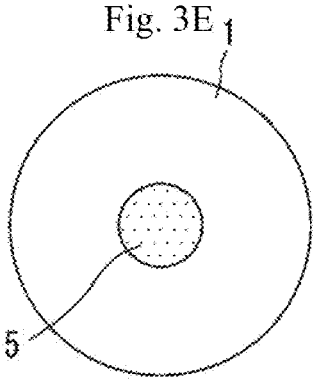
Fig. 3H
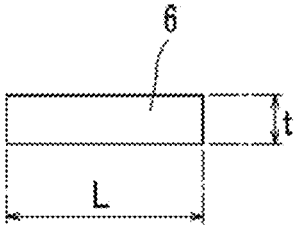
Fig. 3I
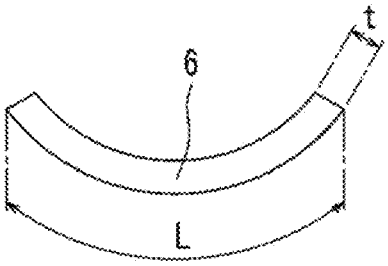
Fig. 3J

STOPPER FOR CONTINUOUS CASTING AND CONTINUOUS CASTING METHOD

FIELD

The present invention relates to a stopper for continuous casting with a gas blowing function, the stopper controlling a flow rate of molten steel by being fitted from above to a nozzle placed in a bottom of a tundish mainly in discharging molten steel from the tundish into a mold in continuous casting of motel steel, and a continuous casting method using the stopper.

BACKGROUND

Some stoppers controlling a flow rate of molten steel in discharging molten steel from a tundish into a mold in continuous casting of molten steel have a gas blowing function for the purpose of floating inclusions in molten steel or preventing deposition of inclusions on a nozzle inner wall or the like.

For example, Patent Literature 1 discloses a pouring apparatus including a gas discharge port (gas jetting port) from which gas guided through a stopper is discharged (jetted) and is passed from an inlet to a lower outlet of a nozzle hole in a pouring vessel bottom, thereby discharging molten metal remaining in the nozzle hole downwardly from the nozzle hole, the pouring apparatus being in a state where, to prevent molten metal from flowing into the gas discharge port, gas pressure is applied to the gas discharge port during pouring.

CITATION LIST

Patent Literature

Patent Literature 1: Japanese Patent Application Laid-open No. 2013-043199

SUMMARY

Technical Problem

Typically, a gas discharge amount from the stopper (hereinafter simply referred to as "gas discharge amount") needs to be changed according to individual operating conditions such as casting speed, i.e., molten steel discharge speed and steel type. Thus, it is necessary to design the size of a through hole for discharging gas and the number of through holes so as to obtain a gas discharge amount required when the changing operating conditions are maximum.

Meanwhile, since the gas discharge amount greatly influences the quality of steel, it is necessary to appropriately control the discharge amount (flow rate) in response to the condition change during casting.

Suppose that the gas discharge amount is controlled to a certain amount or below, especially to a small amount. In this case, as indicated in Patent Literature 1, even if the gas discharge port is to be maintained in a gas pressure (backpressure) applied state, the gas pressure, i.e., backpressure, around a gas discharge portion is reduced since the gas pressure is typically controlled only by an apparatus in a gas supply source located apart from the gas discharge port of the stopper serving as the gas discharge portion. Thus, it is usually difficult to grasp or control the backpressure around the gas discharge portion.

An object of the present invention is to improve the precision of grasping or controlling backpressure around a gas discharge portion in a stopper for continuous casting.

Solution to Problem

The present invention provides a stopper for continuous casting according to the following items 1 to 4, and a continuous casting method according to the following item 5.

1. A stopper for continuous casting including
   - a cavity for conveying gas in a vertical direction center of the stopper,
   - one or a plurality of gas discharge holes passing through from the cavity to the outside in a distal center or a side surface of a reduced-diameter region including a fitted portion to a lower nozzle, and
   - a pressure control component in a part of the reduced-diameter region, the part being above the gas discharge hole within the cavity.

2. The stopper for continuous casting according to the above item 1, in which the pressure control component is placed in an area immediately above the gas discharge hole.

3. The stopper for continuous casting according to the above item 1 or 2, in which
   - the pressure control component is made of a dense refractory having no gas permeability under a condition of pressurizing a sample of the refractory having a length of 20 mm at $8\times10^{-2}$ MPa,
   - the pressure control component includes one or a plurality of through holes disposed within the pressure control component or between an outer periphery of the pressure control component and a body of the stopper so as to pass through from an upper end to a lower end between the pressure control component or the outer periphery of the pressure control component and the body of the stopper,
   - the through hole has a diameter having a size between φ0.2 mm and φ2 mm both inclusive, the size being obtained by assuming a cross section of the hole as a circular shape and converting the cross section into a circle, and
   - the number of through holes satisfies Equations 1 and 2:

$$(-0.44\times Hd^2+1.88Hd-0.08)\leq Ha\leq\{1.67\times\ln(Hd)+3.66\} \quad \text{Equation 1}$$

$$Hn=Ha\div(Hd^2\times\pi\div4) \quad \text{Equation 2, where}$$

- Ha is a numerical value of a total cross-sectional area of the through hole(s),
   - Hn is the number of through holes,
   - Hd is a numerical value of a diameter of the through hole, and
   - π is a circular constant with the total cross-sectional area of the through hole(s) measured in $mm^2$ and the diameter of the through hole measured in mm.

4. The stopper for continuous casting according to the above item 3, in which
   - the through hole has a slit shape (hereinafter referred to as "slit"), where a total cross-sectional area of the slit(s) is regarded as said Ha ($mm^2$) and a thickness of the slit is regarded as said Hd (mm), a value obtained by dividing the total cross-sectional area of the slit(s) by the thickness of the slit is a total length of the slit(s).

5. A continuous casting method using the stopper for continuous casting according to any one of the above items 1 to 4, the method comprising
   - discharging gas into molten steel from the gas discharge hole of the stopper by setting gas pressure in the cavity on an upstream side of the pressure control component to a value between $2\times10^{-2}$ (MPa) and $8\times10^{-2}$ (MPa) both inclusive.

The present invention will be described in detail below.

For a structure in which a gas discharge hole is placed at an end of a cavity as a gas flow path within a stopper, gas backpressure tends to vary greatly and become unstable during an operation of discharging gas from around a distal end of the stopper. The stopper is immersed in molten steel, and is located close to a nozzle hole for discharging molten steel at its distal end. The stopper also controls a flow rate of molten steel. Thus, molten steel flow velocity varies greatly. This causes a flow rate and pressure of gas discharged from around the stopper distal end to vary greatly as well, making it difficult to control them accurately and precisely.

In the present invention, a component that cuts off continuity of the cavity within the stopper to divide the cavity into two upstream and downstream spaces and control pressure (the pressure control component) is placed around a stopper end of the cavity.

The pressure control component controls gas pressure in the upstream space (cavity) without directly transmitting pressure variation from the stopper distal end to the upstream side.

The pressure control component is placed in a part of the reduced-diameter region around the stopper distal end, the part being above the gas discharge hole within the cavity.

The inventors have discovered that when the control component includes a porous refractory the substantially entire of which has gas permeability, the gas permeability within the porous refractory is gradually reduced with the lapse of casting time, and passage or discharge of gas stops in many cases.

This is not caused by a single reason, and its mechanism has not necessarily become clear. However, the inventors have discovered that the phenomenon of stopping passage or discharge of gas in the porous refractory can be resolved by forming the pressure control component with the dense refractory and including the through hole, through which the gas can pass, within the pressure control component or between the outer periphery of the pressure control component and the stopper body.

To accurately and precisely control the pressure or flow rate of gas, the gas pressure in a zone in which the gas pressure is to be adjusted is preferably high.

For the stopper body, a so-called monoblock stopper (hereinafter referred to as "MBS") obtained by integrally forming a refractory such as an alumina inorganic material-graphite is typically used. The inventors have discovered that gas permeates or dissipates into a side wall portion of a body of such a MBS when the gas pressure in the cavity is increased to roughly $1\times10^{-1}$ (MPa) or more.

The inventors have further discovered that it is preferable to discharge gas into molten steel from the gas discharge hole of the stopper by setting the gas pressure in the cavity on the upstream side of the pressure control component to a value between $2\times10^{-2}$ (MPa) and $8\times10^{-2}$ (MPa) both inclusive in consideration of the case using such a MBS.

The value $8\times10^{-2}$ (MPa) as the upper limit of the preferable range is a value including a so-called safety factor such as variation in the shape or the material of each MBS in a pressure of roughly less than $1\times10^{-1}$ (MPa) for preventing gas permeation or dissipation from the side wall portion of the MBS body.

When the gas pressure is less than $2\times10^{-2}$ (MPa), the accuracy and precision of pressure control may be reduced.

The dense refractory in the present invention means a refractory having such a property as not to allow gas permeation when a sample of the refractory having a length of 20 mm (a width and an area are not considered) is pressurized at $8\times10^{-2}$ MPa in a method of measuring a refractory sample in a laboratory.

The pressurization at $8\times10^{-2}$ MPa in this test is obtained by selecting the same pressurizing force as the upper limit value $8\times10^{-2}$ MPa of the gas pressure during operation with the above-described MBS. The length is a practical axial length of the pressure control component, and is obtained by selecting a shortest (thinnest) length in consideration of its strength and placing stability. If the length is greater than 20 mm, the gas permeability is reduced. Thus, if no gas permeates under this condition, a pressure control component greater than this length allows no gas to permeate during operation with the MBS.

The inventors have discovered by simulation that the diameter of the through hole and the number thereof in relation to the pressure control component required for such pressure control are preferably specified as described in the above item 3. The simulation was performed using ordinary fluid analysis software or the like.

In summary, this is a specific condition for determining the number of through holes required for setting the gas pressure in the cavity on the upstream side of the pressure control component to a range between $8\times10^{-2}$ (MPa) and $2\times10^{-2}$ (MPa) both inclusive with respect to any/specific through hole within a range between φ0.2 mm and φ2.0 mm both inclusive. The required number of through holes is obtained by dividing the total cross-sectional area of the through hole(s) obtained by the Equation 1 by the cross-sectional area of the through hole.

The through hole, which preferably has a circular shape, is not necessarily limited to the circular shape. A so-called single hole shape having relatively similar lengths in all directions radially such as an elliptical or another shape having a curved surface (non-perfect circle) and a polygonal shape, or a slit shape (slit) may be employed.

To apply the present invention, the size (diameter) of the single hole shape other than the circle may be determined by converting the hole into a circle based on the cross-sectional area of the hole.

The thickness and the length of the slit may be determined by the conversion method described in the above item 4.

Advantageous Effects of Invention

Conventional techniques including no pressure control component have the following problems.

(a) Backpressure during casting is low, which also occurs during gas leakage. Thus, it is difficult to determine whether gas is stably discharged into molten steel (within a nozzle).

(b) Since gas backpressure has a low absolute value, it is extremely difficult to control the gas backpressure.

(c) Variation in backpressure and flow rate easily occurs during gas discharge, making it difficult to stably discharge gas.

(d) Since it is difficult to stably discharge gas, nozzle clogging or deterioration of fluidity and inclusion floatation within a mold easily occurs, finally resulting in quality deterioration of steel due to inclusions.

The stopper of the present invention can solve these problems by including therein the pressure control component.

That is, the present invention makes it possible to grasp the gas backpressure in a portion near the gas discharge hole around the stopper distal end. This enables more precise grasping and management/control of a state of gas discharged into molten steel. Distribution or the like of gas in molten steel can be thereby controlled more precisely. Consequently, the quality of steel can be stabilized or improved.

If the pressure control component is placed in an upper region other than the reduced-diameter region, molten steel may enter and clog the gas discharge hole especially when a gas discharge amount from the gas discharge hole placed around the stopper distal end is small.

In comparison, in the present invention, the pressure control component is provided in a part of the reduced-diameter region having a reduced refractory thickness from the stopper outer periphery to the inner cavity. Thus, the temperature of the pressure control component can be increased, and the temperature of gas passing through the pressure control component can be quickly increased. The gas pressure around the gas discharge hole can also be increased. This configuration can prevent molten steel entering the gas discharge hole, if any, from easily solidifying. Consequently, the possibility to clog the gas discharge hole can be reduced.

Moreover, for the phenomenon of stopping passage or discharge of gas due to a decrease in gas permeability in the porous refractory when the pressure control component includes the porous refractory the substantially entire of which has gas permeability as described above, the configuration can prevent a gas amount passing through the pressure control component and a gas discharge amount from the stopper distal end from being decreased or stopped.

BRIEF DESCRIPTION OF DRAWINGS

FIGS. 3A-3J are images of an upper end surface of the pressure control component of the present invention as viewed from above.

DESCRIPTION OF EMBODIMENTS

Embodiments of the present invention will be described together with examples (water model experiment examples).

Figure 1:
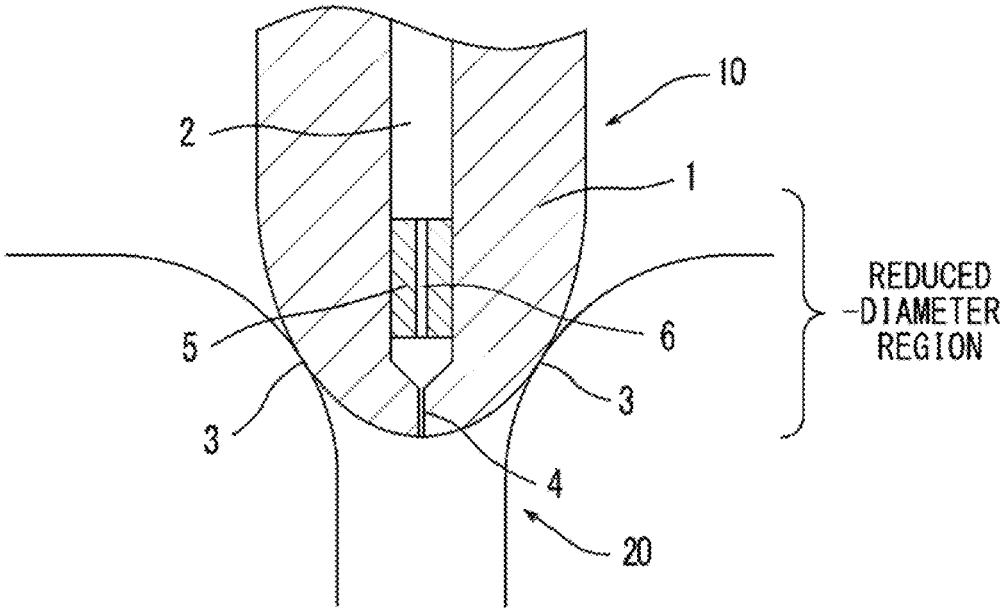
FIG. 1 is an example of a stopper including a pressure control component and a gas discharge hole of the present invention, the gas discharge hole existing in a distal center of a reduced-diameter region.

FIG. 1 illustrates a vertical cross-sectional view of main parts of a stopper as an example of the present invention together with a lower nozzle. A stopper 10 illustrated in FIG. 1 includes a cavity 2 for conveying gas in a vertical direction center of the stopper. That is, the cavity 2 is provided so as to extend vertically in the center of a stopper body 1, and an unillustrated gas supply source is connected to an upper end of the cavity 2. The stopper 10 is typically located in a tundish so as to control a flow rate of molten steel by being fitted from above to a nozzle (lower nozzle) 20 placed in a bottom of the tundish.

The stopper 10 includes a gas discharge hole 4 passing through from the cavity 2 to the outside in a distal center of a reduced-diameter region including a fitted portion 3 to the lower nozzle 20. The stopper 10 further includes a pressure control component 5 in a part of the reduced-diameter region above the gas discharge hole 4 within the cavity 2.

Figure 2:
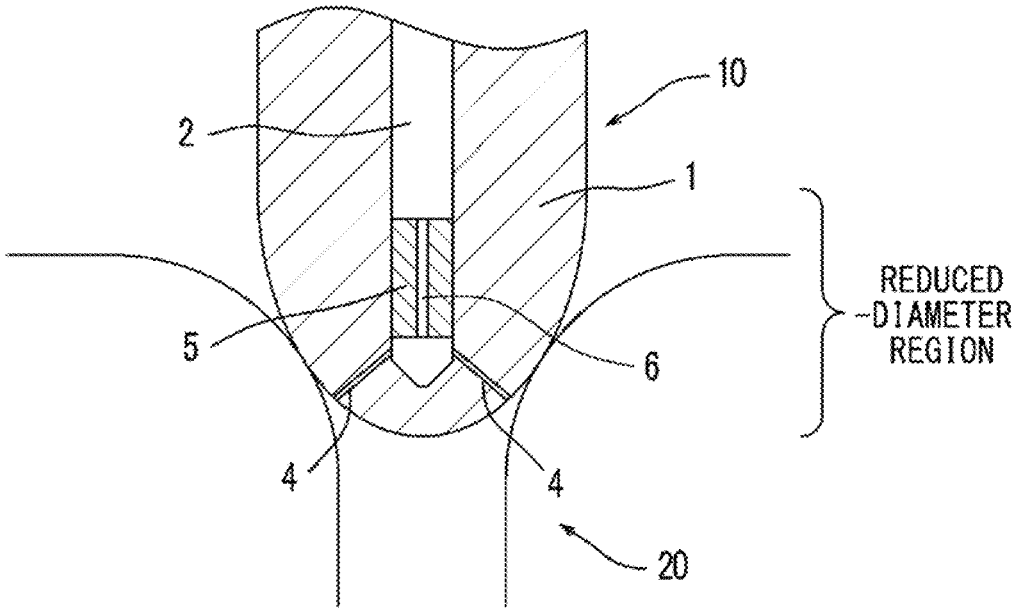
FIG. 2 is another example of the stopper including the pressure control component and gas discharge holes of the present invention, the gas discharge holes existing in a side surface of the reduced-diameter region.

The gas discharge hole 4 may be also provided in a side surface of the reduced-diameter region, and may be provided at a plurality of positions as illustrated in FIG. 2. Additionally, the gas discharge hole 4 may be formed in a slit shape.

As described above, the stopper of the present invention includes the pressure control component in a part of an area above the gas discharge hole, preferably in an area immediately above the gas discharge hole. This is because it is preferable to grasp and control pressure at a position as close as possible to the discharge hole in order to more accurately and precisely grasp and control a state of gas discharged from around a distal end of the stopper. The position as close as possible to the discharge hole is an area roughly below a diameter reduction starting position of the stopper distal end. To be more specific, the area is roughly within 150 mm from the distal end of the stopper body.

The gas discharge hole in the stopper of the present invention is a distal opening of the cavity for conveying gas. The discharge hole may be located at one position in the distal center of the reduced-diameter region or at a plurality of positions around the fitted portion (side surface). It should be noted that a total opening area of the gas discharge hole is preferably about 3.1 $mm^2$ (equivalent to an opening area of a hole having a diameter of 2 mm) or less.

While the pressure control component may have any one of a porous body (porous refractory) form or a through hole form, the pressure control component preferably controls a flow rate of gas under higher pressure. The gas permeability characteristics of the pressure control component and the gas discharge hole defined in the above Equation 1 are individually measured in a laboratory.

Additionally, a decrease in gas amount, clogging or the like may occur when the pressure control component is a porous body (porous refractory). In this case, it is preferable to use a dense refractory for the pressure control component as described above and form a through hole within the pressure control component or between the outer periphery of the pressure control component and the stopper body so as to satisfy conditions in the equations or the like in the above item 3.

FIGS. 3A to 3J illustrate formation and shape examples of the through hole.

FIG. 3A is an example in which the pressure control component 5 having a through hole 6 is placed in the stopper body 1 via a joint filler 7.

FIG. 3B is an example in which the pressure control component 5 having a plurality of through holes 6 is placed in the stopper body 1 via the joint filler 7.

FIG. 3C is an example in which the through holes 6 are formed as grooves in the outer periphery of the pressure control component 5 placed in the stopper body 1 without the joint filler.

FIG. 3D is an example in which the through holes 6 are formed in the joint filler 7 between the outer periphery of the pressure control component 5 and the stopper body 1.

FIG. 3E is an example in which the through holes 6 are formed as grooves in the cavity 2 of the stopper body 1 between the outer periphery of the pressure control component 5 and the stopper body 1, and the pressure control component 5 is placed without using the joint filler.

FIG. 3F is an example in which the pressure control component 5 having the slit-shaped through holes (slits) 6 is placed in the stopper body 1 via the joint filler 7.

FIG. 3G is an example in which the slit-shaped through holes (slits) 6 are formed between the outer periphery of the pressure control component 5 and the stopper body 1.

FIG. 3H is an example in which the pressure control component 5 made of a porous refractory is placed in the stopper body 1. While no joint filler is used in FIG. 3H, the joint filler may be used.

FIG. 3I is a view illustrating a thickness t and a length L of an example in which the through hole 6 has a slit shape.

FIG. 3J is a view illustrating a thickness t and a length L of another example in which the through hole 6 has a slit shape.

In the present invention, the through hole may have various shapes as in the examples of the through hole illustrated in FIGS. 3A to 3G, 3I, 3J, and 5. While FIG. 3H is an example in which the pressure control component 5 is the porous body (porous refractory), the pressure control component 5 may have various forms. For example, the pressure control component 5 may be wholly or partially made of the porous body, or may be placed via the joint filler.

Figure 4:
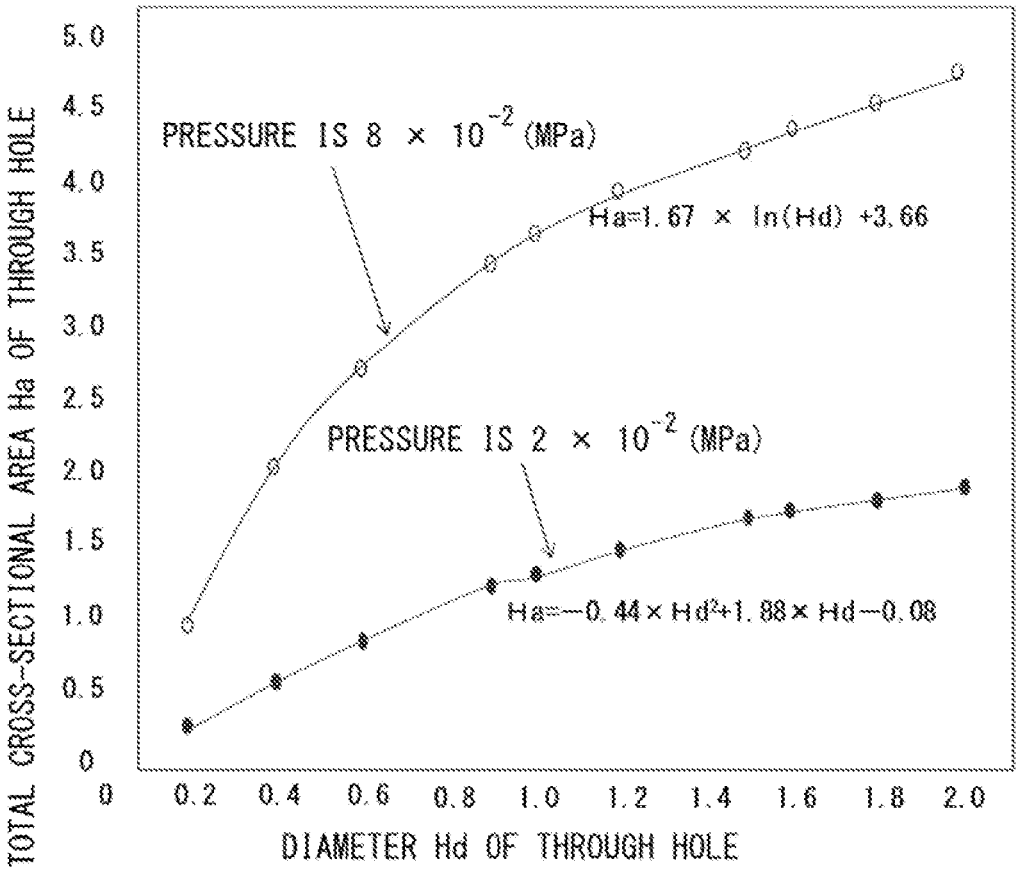
FIG. 4 is a graph obtained by simulating a relation between a diameter and a total cross-sectional area of a through hole at a pressure of $2\times10^{-2}$ (MPa) and $8\times10^{-2}$ (MPa) when the total cross-sectional area of the through hole(s) is measured in $mm^2$ and the diameter of the through hole is measured in mm.

The through hole(s) may be located so as to fall under a range of an approximate curve representing a relation between a diameter and a total cross-sectional area of a circular through hole at a pressure of $2\times10^{-2}$ (MPa) and $8\times10^{-2}$ (MPa) (pressure of the cavity on an upstream side of the pressure control component) as illustrated in FIG. 4. In other words, the number of through holes equal to a value obtained by dividing a value (Ha) of the total cross-sectional area of the through hole(s) represented on the vertical axis of the graph in FIG. 4 by a cross-sectional area ($Hd^2\times\pi\div4$) of the through hole having a value (Hd) of the diameter of the through hole on the horizontal axis thereof may be located in the pressure control component with the total cross-sectional area of the through hole(s) measured in $mm^2$ and the diameter of the through hole measured in mm.

The through hole may have a single hole shape such as the above circular shape, an elliptical or another shape having a curved surface (non-perfect circle), and a polygonal shape, or may have a slit shape.

Figure 5:
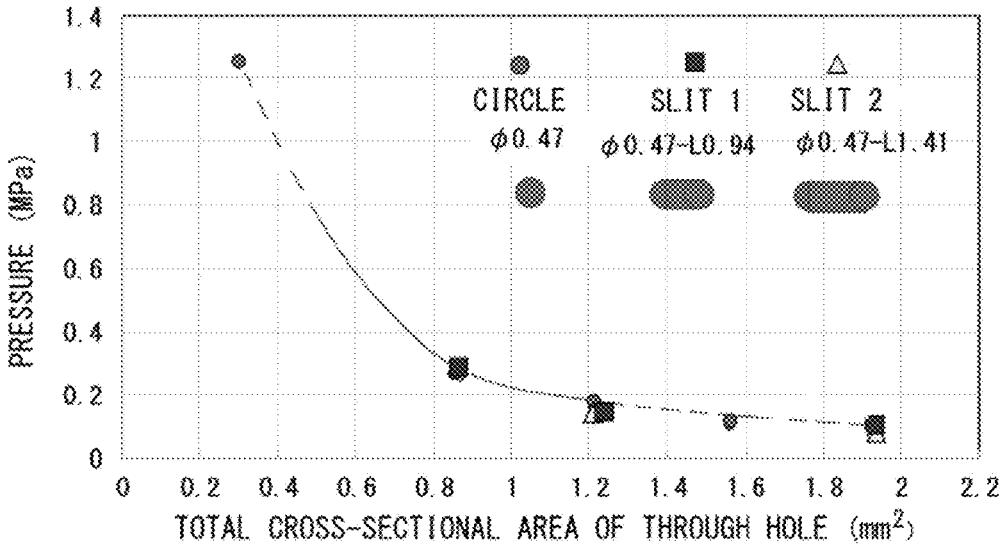
FIG. 5 is a graph illustrating an example obtained by simulating a difference in gas pressure when through holes with the shape of circle and two types of elongated circles have the same total cross-sectional area (adjusted by the number of through holes).

FIG. 5 illustrates an example in which the shape of the through hole is compared between the circular shape and the slit shapes. The slit in this example is shaped such that its opposite ends have partially circular shapes, which are elongated outward from the opposite ends. In this example, pressure values (pressure values of the cavity on the upstream side of the pressure control component) obtained when the through holes have the same total cross-sectional area were observed. Here, the same total cross-sectional area was obtained by changing the numbers of the respective through holes.

The result shows that the circular shape and the slit shapes have little pressure difference. That is, for the slit-shaped through hole, the shape and number thereof may be determined using the conversion method described in the above item 4.

Figure 6:
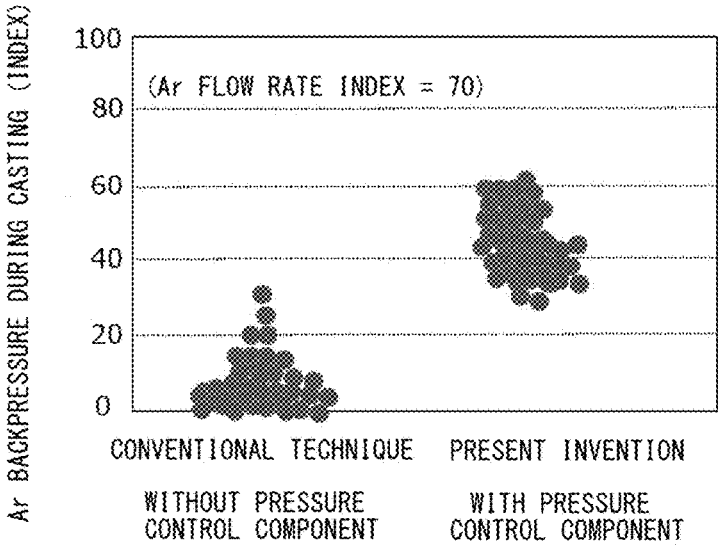
FIG. 6 is a graph illustrating an example of gas backpressure during casting in the present invention including the pressure control component and in a conventional technique including no pressure control component.

FIG. 6 illustrates an example of gas (Ar) backpressure during casting in the present invention including the pressure control component (FIGS. 1 and 3A, the same applies hereinafter) and in a conventional technique including no pressure control component. It is shown that the backpressure is extremely low in the conventional technique including no pressure control component, whereas the backpressure can be controlled to be high in the present invention including the pressure control component.

Figure 7:
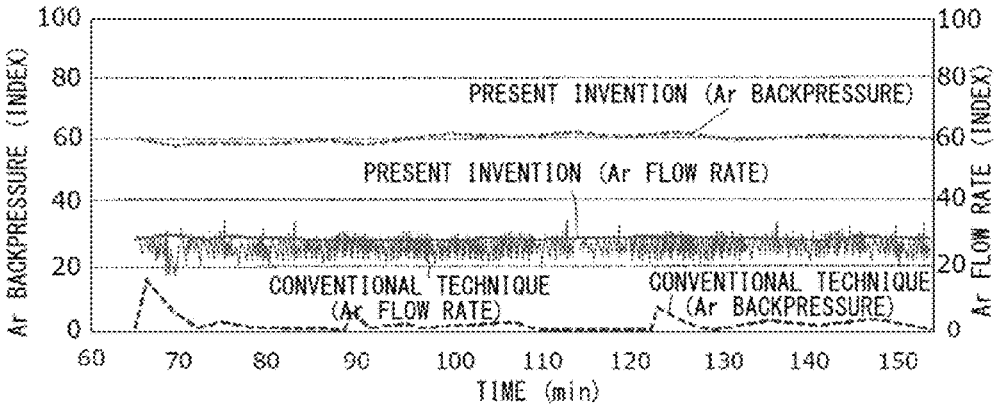
FIG. 7 is a graph illustrating an example of variation in gas backpressure and flow rate during casting in the present invention including the pressure control component and in the conventional technique including no pressure control component.

FIG. 7 illustrates an example of variation in gas (Ar) backpressure and flow rate during casting in the present invention including the pressure control component and in the conventional technique including no pressure control component. It is shown that not only the backpressure but the gas flow rate (discharge amount) is also more stable in the present invention including the pressure control component than in the conventional technique including no pressure control component.

Figure 8:
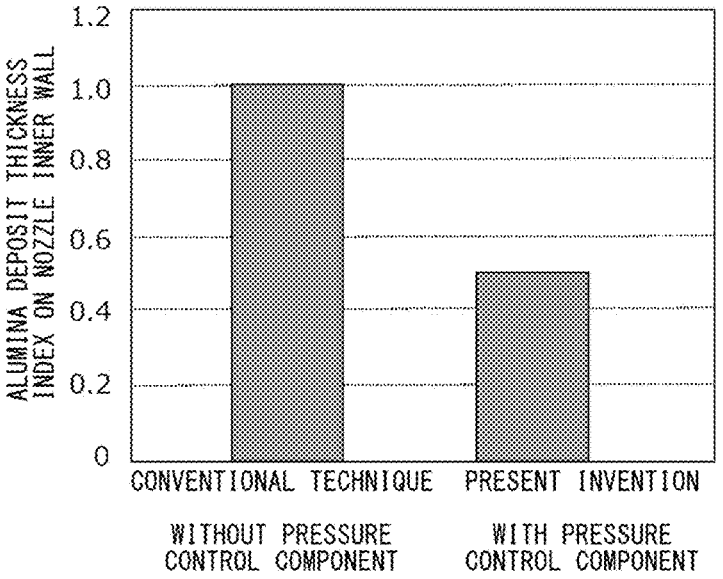
FIG. 8 is a graph illustrating an example of a deposit thickness (the conventional technique is 1 as an index) of alumina-based inclusions on a nozzle inner wall in the present invention including the pressure control component and in the conventional technique including no pressure control component.

FIG. 8 illustrates an example of a deposit thickness (the conventional technique is 1 as an index) of alumina-based inclusions on a nozzle inner wall in the present invention including the pressure control component and in the conventional technique including no pressure control component. It is shown that the deposit thickness of alumina-based inclusions on a nozzle inner wall is smaller in the present invention including the pressure control component than in the conventional technique including no pressure control component.

Figure 9:
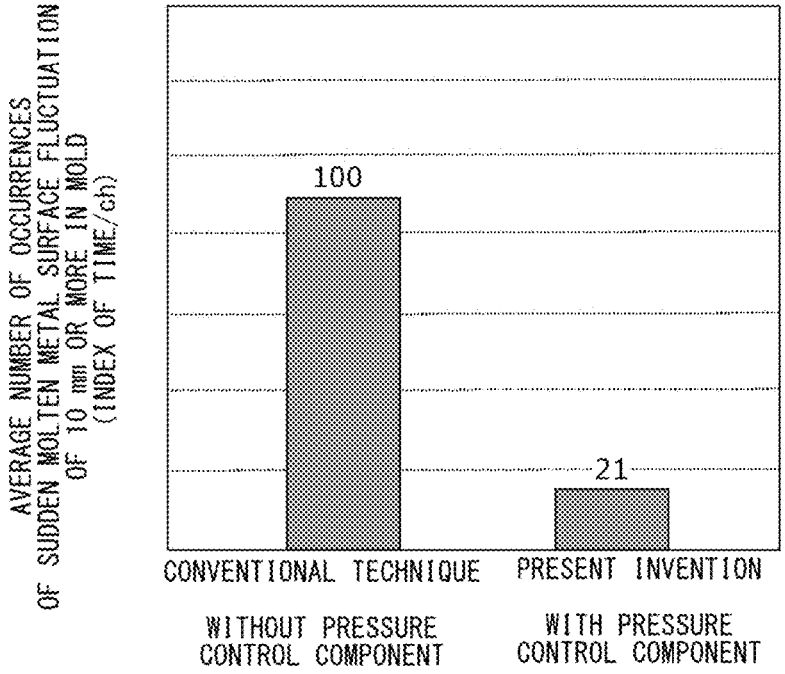
FIG. 9 is a graph illustrating an example of the average number of occurrences (time/ch) of a sudden molten metal surface fluctuation of 10 mm or more in a mold in the present invention including the pressure control component and in the conventional technique including no pressure control component.

FIG. 9 illustrates an example of the average number of occurrences (time/ch) of a sudden molten metal surface fluctuation of 10 mm or more in a mold in the present invention including the pressure control component and in the conventional technique including no pressure control component. It is shown that the average number of occurrences of a sudden molten metal surface fluctuation of 10 mm or more in a mold is also smaller in the present invention including the pressure control component than in the conventional technique including no pressure control component.

When the gas discharge hole is located at one position in the distal center of the reduced-diameter region of the stopper, the gas discharge hole is preferably disposed at a position within +10 mm in a radial direction of the stopper from the vertical center axis of the stopper. This is because disposing the gas discharge hole at the above position makes it hard for the discharged gas flow to receive the effect of a molten steel flow flowing along the outer periphery of the stopper distal end (so-called head portion), and bubbles to hardly join together, thereby preventing generation of coarse bubbles. As a result, nozzle clogging can be efficiently prevented, and inclusion floatation in the mold can be efficiently promoted.

When the gas discharge hole is located at a plurality of positions around the distal end of the reduced-diameter region of the stopper, the gas discharge hole is preferably disposed at positions away from the vertical center axis of the stopper by 10 mm or more in the radial direction of the stopper up to the fitted portion (contact point with the lower nozzle). This is because disposing the gas discharge hole at the above positions allows the discharged gas flow to be dispersed, and makes it difficult for bubbles to join together, thereby preventing generation of coarse bubbles. As a result, nozzle clogging can be efficiently prevented, and inclusion floatation in the mold can be efficiently promoted. Discharging gas below the fitted portion (contact point with the lower nozzle) makes it possible to certainly blow the gas into an inner hole of the lower nozzle.

Figure 10:
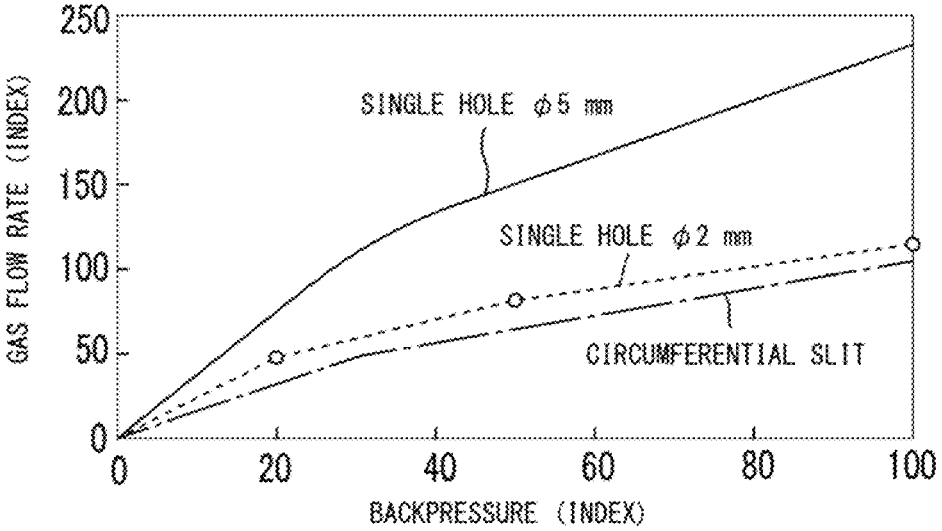
FIG. 10 is an example of experiment on a water model illustrating gas flow rate/backpressure characteristics using gas discharge holes having different forms and diameters.
Figure 11:
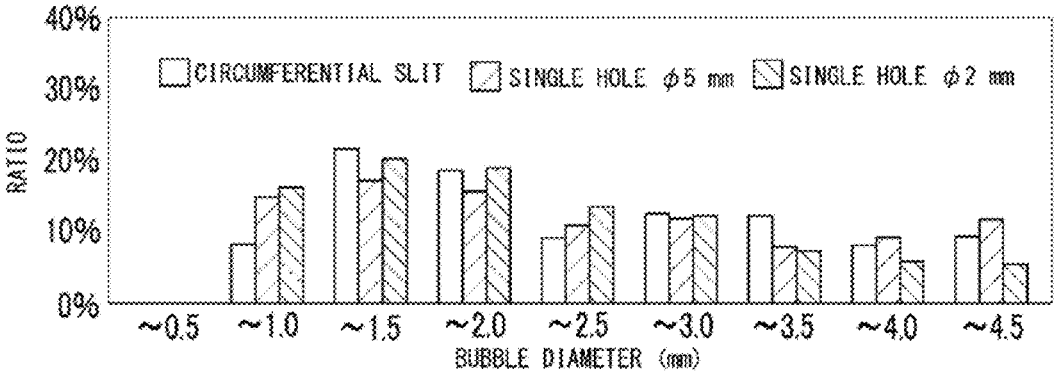
FIG. 11 is an example of experiment on a water model illustrating a bubble diameter and an existence ratio assuming the inside of a mold using gas discharge holes having different forms and diameters.

When the gas discharge hole is located at one position of the distal center or at a plurality of positions of the side surface of the reduced-diameter region of the stopper, experiment shows that the distal opening (discharge port) of the gas discharge hole preferably has a diameter of 2 mm or less. This is because the flow rate can be controlled more precisely, and there is a higher ratio of bubbles having a small diameter (roughly less than 3 mm), which allow inclusions in molten steel to easily float up and make it difficult to produce steel defects. FIGS. 10 and 11 illustrate these water model experiment results.

REFERENCE SIGNS LIST

10 STOPPER
1 STOPPER BODY
2 CAVITY
3 FITTED PORTION
4 GAS DISCHARGE HOLE
5 PRESSURE CONTROL COMPONENT
6 THROUGH HOLE
7 JOINT FILLER
20 LOWER NOZZLE

The invention claimed is:

1. A stopper for continuous casting comprising:

a cavity for conveying gas in a vertical direction center of the stopper;

one or a plurality of gas discharge holes passing through from the cavity to the outside in a distal center or a side surface of a reduced-diameter region including a fitted portion to a lower nozzle; and a pressure control component in a part of the reduced-diameter region, the part being above the gas discharge hole within the cavity, wherein the pressure control component is made of a dense refractory having no gas permeability under a condition of pressurizing a sample of the refractory having a length of 20 mm at $8\times10^{-2}$ MPa, wherein the pressure control component includes one or a plurality of through holes disposed within the pressure control component or between an outer periphery of the pressure control component and a body of the stopper so as to pass through from an upper end to a lower end between the pressure control component or the outer periphery of the pressure control component and the body of the stopper, wherein the through hole has a diameter having a size between φ0.2 mm and φ2 mm both inclusive, the size being obtained by assuming a cross section of the hole as a circular shape and converting the cross section into a circle, and wherein the number of through holes satisfies Equations 1 and 2:

$$(-0.44\times Hd^2+1.88Hd-0.08)\leq Ha\leq\{1.67\times\ln(Hd)+3.66\} \quad \text{Equation 1}$$

$$Hn=Ha\div(Hd^2\times\pi\div4) \quad \text{Equation 2, where}$$

Ha is a numerical value of a total cross-sectional area of the through hole(s),

Hn is the number of through holes,

Hd is a numerical value of a diameter of the through hole, and

π is a circular constant, with the total cross-sectional area measured in $mm^2$ and the diameter of the through hole measured in mm.

2. The stopper for continuous casting as claimed in claim 1, wherein the pressure control component is placed in an area below a diameter reduction starting position of a stopper distal end.

3. The stopper for continuous casting as claimed in claim 1, wherein the through hole has a slit shape (hereinafter referred to as "slit"), where a total cross-sectional area of the slit(s) is regarded as said Ha ($mm^2$) and a thickness of the slit is regarded as said Hd (mm), a value obtained by dividing the total cross-sectional area of the slit(s) by the thickness of the slit is a total length of the slit(s).

4. A continuous casting method using the stopper for continuous casting as claimed in claim 1, the method comprising A discharging gas into molten steel from the gas discharge hole of the stopper of claim 1 by setting gas pressure in the cavity on an upstream side of the pressure control component to a value between $2\times10^{-2}$ (MPa) and $8\times10^{-2}$ (MPa) both inclusive.

* * * * *